US005359733A

United States Patent [19]

Brannon et al.

[11] Patent Number: 5,359,733

[45] Date of Patent: Nov. 1, 1994

[54] PATCH ATTACHMENTS FOR HATS

[76] Inventors: Garry A. Brannon, 5715 Spence Cir., College Park, Ga. 30349; Michael S. Jacobson, 2886 Sandpiper Cir., Atlanta, Ga. 30311

[21] Appl. No.: 120,572

[22] Filed: Aug. 30, 1993

[51] Int. Cl.[5] ..... A42B 1/24

[52] U.S. Cl. ..... 2/195.1; 2/209.13; 2/918

[58] Field of Search ..... 2/171, 175.1, 175.3, 2/195.1, 195.7, 209.13, 244, 246, 422, 909, 912, 918; 40/329

[56] References Cited

U.S. PATENT DOCUMENTS

| | | | |
|---|---|---|---|
| 3,895,797 | 7/1975 | Moore . | |
| 4,611,355 | 9/1986 | Galanto . | |
| 4,776,043 | 10/1988 | Coleman . | |
| 4,918,758 | 4/1990 | Redina . | |
| 5,003,640 | 4/1991 | Pizzacar . | |
| 5,136,726 | 8/1992 | Kellin et al. . | |
| 5,147,129 | 9/1992 | Ku . | |
| 5,253,368 | 10/1993 | Blake | 2/918 |

FOREIGN PATENT DOCUMENTS

| | | | |
|---|---|---|---|
| 1259571 | 3/1961 | France | 2/918 |

*Primary Examiner*—Clifford D. Crowder
*Assistant Examiner*—Diana L. Biefeld
*Attorney, Agent, or Firm*—Richard C. Litman

[57] ABSTRACT

The instant invention provides a hat that may simultaneously accept a plurality of patches. The patches may be connected to the hat by hook and loop fasteners. The hat may be a six-panel baseball cap having an area of hook material either integrally forming a portion of the cap or retrofitted to a pre-existing six-panel cap. A rear area of hook material may also be provided, which may receive a patch or patches. A border of material such as embroidered stitching or paint may bound or surround one or more the areas of hook material. The hat and patches may also provided in the form of a kit. The kit may include a display ant storage board covered along one surface with hook material. The display and storage board should be sized to accommodate a plurality of patches for a sports team.

16 Claims, 3 Drawing Sheets

PATCH ATTACHMENTS FOR HATS

BACKGROUND OF THE INVENTION

1. Field of the Invention

The present invention relates to interchangeable patches for head wear, more particularly, the invention is directed to a hat for use with a plurality of releasably attached patches.

2. Description of the Prior Art

Various hats and other articles worn on a user's head have been developed for releasably attaching patches to a hat. These hats are directed toward merely attaching a patch or patches to the hat and do not contemplate a hat configured to maintain a neat appearance and enhance the attachment and release of the patches.

U.S. Pat. No. 4,611,355 discloses convertible patches for apparel including patches 16, 16' connectable to pile layer 14 of cap 10. The pile layer may be formed as an integral portion of the cap's structure or may be permanently attached to an already existing cap.

U.S. Pat. No. 4,776,043 discloses a hat and logo including a hat 1 and series of separate patches 20*a*, 20*b*, 20*c*. The hat includes an incomplete phrase, which may be completed by attaching one of the patches to the hat by hook and loop fasteners.

U.S. Pat. No. 5,136,726 discloses stretchable articles apparel with detachable decorative elements. A plurality of decorative elements 14 may be attached to a baseball cap 32 by hook and loop fasteners.

None of the above inventions and patents, taken either singly or in combination, is seen to describe the instant invention as claimed.

SUMMARY OF THE INVENTION

The present invention provides a hat that maintains a neat appearance and releasably accepts a plurality of interchangeable patches.

Accordingly, it is a principal object of the invention to provide a hat that simultaneously accepts a plurality of user selected patches.

It is another object of the invention to provide a hat having integral portions of hook or loop material, so a patch may be connected to the hat by a hook and loop fastener.

It is a further object of the invention to inexpensively provide a modifiable article of apparel that may be coordinated with a user's particular mood or sentiment.

It is an object of the invention to provide improved elements and arrangements thereof in an apparatus for the purposes described which is inexpensive, dependable and fully effective in accomplishing its intended purposes.

The instant invention provides a hat that may simultaneously accept a plurality of patches. The patches may be connected to the hat by hook and loop fasteners. The hat may be a six-panel baseball cap having an area of hook material either integrally formed as one of the panels or retrofitted to a pre-existing six-panel cap. The hook area may be surrounded or bounded by a border of stitching that provides two functions: (1) a billboard effect of contrasting color enhances the visibility of a patch connected to the hat, and (2) an non-hook area is provided to facilitate placement and removal of the patch with respect to the hat.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
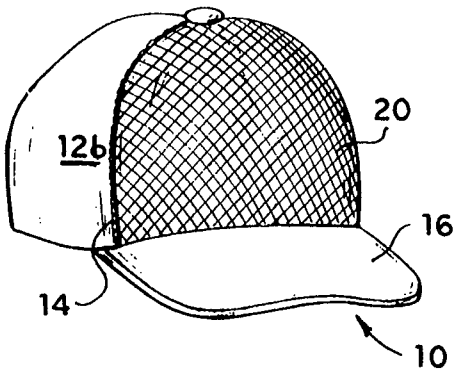
FIG. 1 is a front perspective view of a six-panel hat and two-panel patch bounded by a border according to the instant invention.
Figure 2:
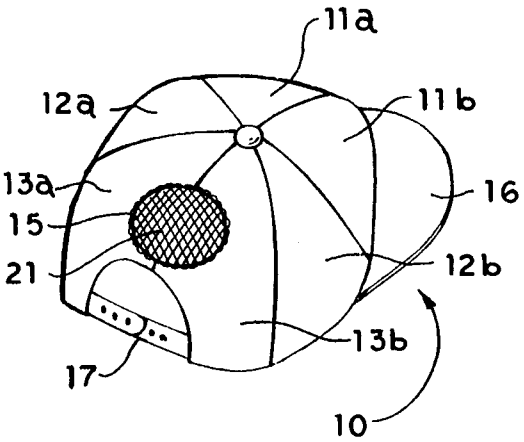
FIG. 2 is a rear perspective view of the hat of FIG. 1, with a circular patch attached to the hat and bounded by a border.

FIGS. 1 and 2 show a front perspective view of a hat 10 including a patch 20 bounded by a border 14 according to the instant invention. The hat may be configured as a six-panel, baseball-style cap having a crown or head covering portion including left front panel 11*a*, left side panel 12*a*, left rear panel 13*a*, right front panel 11*b*, right side panel 12*b* and right rear panel 13*b*.

The cap may also include bill or visor 16 and size-adjusting mechanism 17. A first area of hook material (not shown) may have a contour matching a contour of the patch and may be permanently attached to the front of the cap. A second patch 21 may cover a second area of hook material (not shown) that may be permanently attached to the rear of the cap. According to the preferred embodiment, a contour of the second area of hook material matches the contour of patch 21. Front border 14 and rear border 15 of material, which are discussed in detail below, provide a billboard effect. According to the preferred embodiment, the cap is made of a woven textile or fabric.

As shown in FIG. 1, the first area of hook material may be integral to the cap and forms front panels 11*a*, 11*b*. The first area of hook material may be bounded by a border 14 of material. The border may be double-stitched thread, triple-stitched thread, or an embroidered edge of thread. It is also contemplated to provide a border of paint that adheres to the cap's fabric. The border provides a billboard effect of contrasting color that enhances the visibility of a patch connected to the hat, and a non-hook area is provided to facilitate placement and removal of the patch with respect to the hat.

In other words, the non-hook area provided by the border ensures that the loop material along the edges of the patch that overlay the border do not contact hook material and act as a lip that may be easily grasped to remove a patch from the hat. Further, the difference in material, i.e., hook material, the border material, and the fabric of the cap, readily provides tactile feedback, so the user may properly align a patch without viewing the cap.

Figure 3:
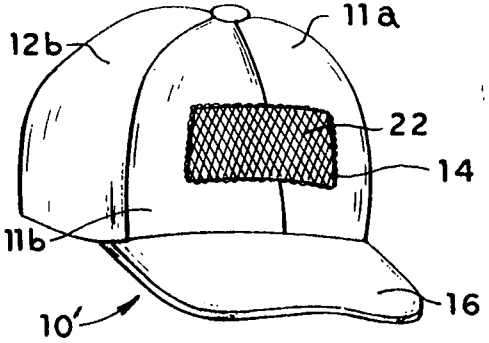
FIG. 3 is a front perspective view of a second embodiment of the invention with a six-panel hat and a rectangular patch bounded by a border.

FIG. 3 shows a second embodiment 10' of a six-panel hat and a rectangular patch 22 covering an identically shaped rectangular first area of hook material (not shown) bounded by a border 14 of stitching or paint.

Figure 4:
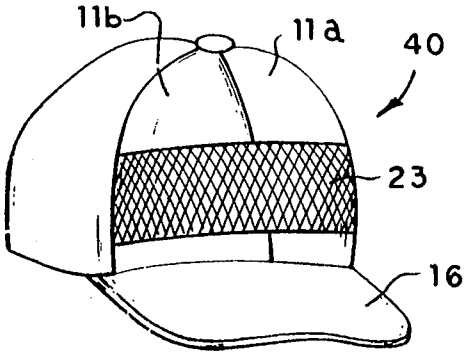
FIG. 4 is a front perspective view of a third embodiment of the invention with a six-panel hat and spanning patch.

FIG. 4 shows a third embodiment 40 of a six-panel hat and a spanning rectangular patch 23 that terminates at the edges of the front panels of the cap. Patch 23 covers an identically shaped spanning rectangular first area of hook material (not shown). Although the third embodiment omits the border, it is within the scope of the invention to provide a border on an area of hook material with any of the illustrated embodiments, wherein the billboard or enhanced feel and look is desired. It should be understood that the addition of the border reduces the amount of functional hook material, as the border contacts the hook material and the paint or stitching precludes the covered portion of hook material from functioning as a fastener.

Figure 5:
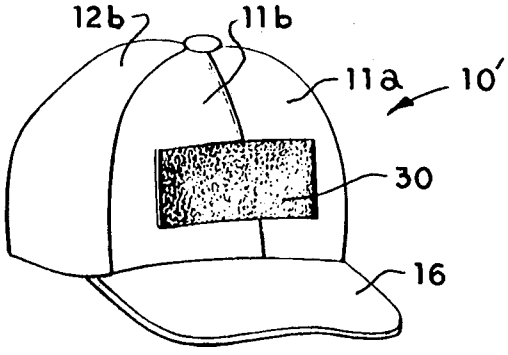
FIG. 5 is a front perspective view of another embodiment the invention with an exposed hook area, a patch is omitted for clarity.

FIG. 5 is similar to the second embodiment (see FIG. 3), but omits border 14 and identically shaped patch 22. First area 30 of hook material is clearly shown. All embodiments of the cap include a first area of hook material. Applicants have determined that the use of hook material on the cap provides the advantage of a neater appearance, as the hook material provides less contrast with the remainder of the cap than loop material.

Applicants have further determined that the use of hook material should be tailored to the particular function provided by the hat. For example, the two panel construction shown in FIG. 1 and FIG. 8 below permit the simultaneous display of a plurality of patches on the respective hook area, when a single identically contoured patch is not used.

According to the preferred embodiment, hook material should only be placed in locations on the cap where a user is likely to apply a patch or patches. The hook material is likely to gather lint or thread, which results in an unsightly appearance. By minimizing the location of hook material on the hat or cap ensures that large areas of the cap are not susceptible to gathering lint or thread. Further, the minimized area of hook material requires less cleaning effort than a larger area, i.e., the entire cap covered with loop material.

Figure 6:
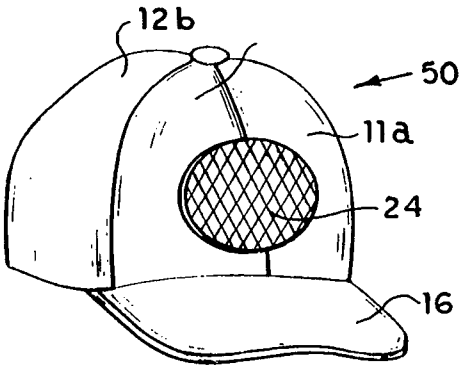
FIG. 6 is a front perspective view of another embodiment of the invention with a six-panel hat and an oval patch.

FIG. 6 shows a further embodiment 50 of a six-panel hat and a large circular patch 24, which covers an identically shaped oval or substantially circular first area of hook material (not shown).

Figure 7:
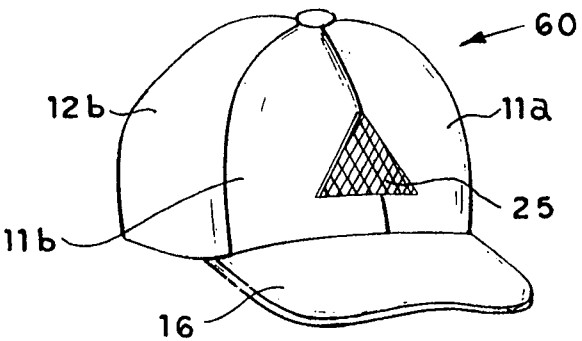
FIG. 7 is a front perspective view of another embodiment of the invention with a six-panel hat and a triangular patch.

FIG. 7 shows an additional embodiment 60 of a six-panel hat and a triangular patch 25, which covers an identically shaped triangular first area of hook material (not shown).

Figure 8:
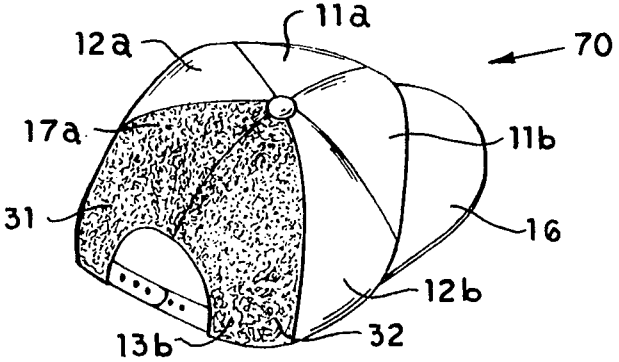
FIG. 8 is a rear perspective view of a six-panel hat having two-panels of hook material, a patch is omitted for clarity.

FIG. 8 shows a rear portion of a six-panel hat having two-panels 31, 32 of hook material constructed as an integral part of the hat during fabrication to provide a neat, attractive appearance.

Figure 9:
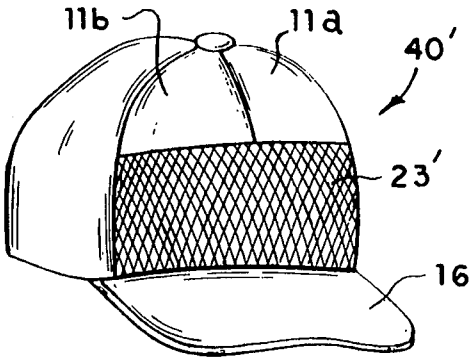
FIG. 9 is a front perspective view of another embodiment of the invention with a six-panel hat and spanning patch.

FIG. 9 shows a six-panel cap or hat 40' and a spanning rectangular patch 23' that both terminate at the lower edges of the panel adjacent the cap visor and the side edges of the front panels of the cap. Patch 23' covers an identically shaped spanning rectangular first area of hook material (not shown).

Figure 10:
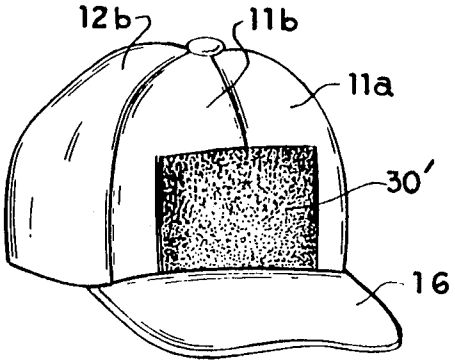
FIG. 10 is a front perspective view of another embodiment of the invention, a patch is omitted for clarity.

FIG. 10 shows an additional embodiment of a six panel hat having a first area 30' of hook material that terminates at lower edges of the front panels along the top edge of the visor or brim of the cap.

Figure 11B:
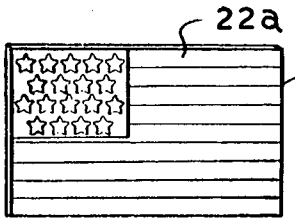
FIG. 11*b* is a front perspective view of a rectangular patch according to the invention.
Figure 11D:
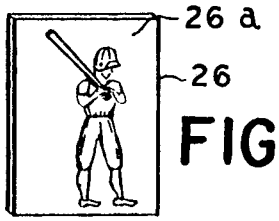
FIG. 11*d* is a front perspective view of another rectangular patch according to the invention.
Figure 11A:
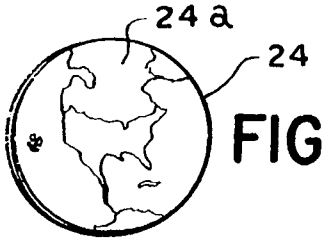
FIG. 11*a* is a front perspective view of a circular patch according to the invention.

FIG. 11*a* shows circular patch 24 having a first surface 24*a* bearing visual indicia, i.e., a representation of the planet Earth. The patch includes a second surface (not shown) opposite the first surface which is covered with loop material.

FIG. 11*b* shows rectangular patch 22 having a first surface 22*a* bearing visual indicia, i.e., a flag. The patch includes a second surface (not shown) opposite the first surface which is covered with loop material.

Figure 11C:
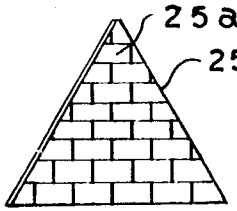
FIG. 11*c* is a front perspective view of a triangular patch according to the invention.

FIG. 11*c* shows a triangular patch 25 having a first surface 25*a* bearing visual indicia, i.e., a pyramid. The patch includes a second surface (not shown) opposite the first surface which is covered with loop material.

FIG. 11*d* shows a rectangular patch 26 having a first surface 26*a* bearing visual indicia, i.e., a baseball card showing a baseball player. The patch includes a second surface (not shown) opposite the first surface which is covered with loop material. It is contemplated to provide a plurality of patches in the form of a pack of baseball patches or for another sport or interesting topic. Users may wish to purchase a pack of patches for sporting events or of favorite athletes for selective wear of one or several patches at a time.

Figure 12A:
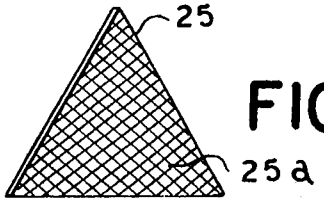
FIG. 12*a* is a front perspective view of another triangular patch according to the invention.
Figure 12B:
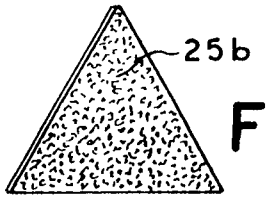
FIG. 12*b* is a rear perspective view of the patch of FIG. 12*a*.

FIGS. 12*a* and 12*b* show the first and second surfaces, respectively, of a triangular patch. First surface 25*a* bears visual indicia and second surface 25*b* opposite the first surface is covered with loop material.

Figure 13C:
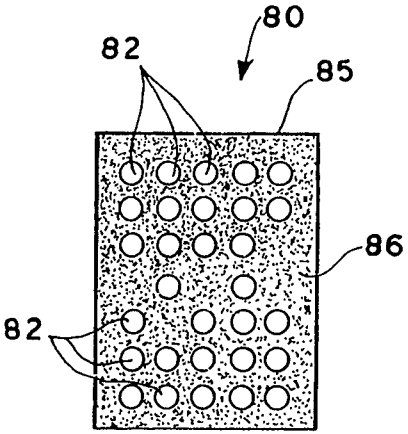
FIG. 13*c* is a side elevation view of a display and storage board and patches according to the kit of FIG. 13*a*.
Figure 13B:
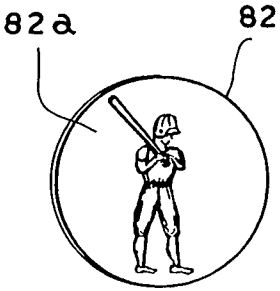
FIG. 13*b* is an enlarged front perspective view of a patch according to the kit of FIG. 13*a*.
Figure 13A:
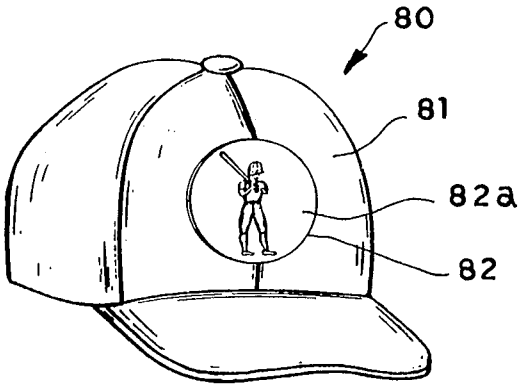
FIG. 13*a* is a front perspective view of a kit including a hat, patch and display and storage board, the board is omitted for clarity.

FIGS. 13*a*, 13*b* and 13*c* show a kit 80 including a cap or hat 81 with a circular first area of hook material (not shown), an identically shaped patch 82 having a second or rear surface covered with loop material and a display and storage board 85 having a first or front surface 86 covered with hook material. The cap may be constructed according to any of the above-mentioned embodiments, i.e., may include a second rear area of hook material and one or more borders.

The patch may be configured according to any predetermined shape, however, it is preferred that circular or rectangular patches are used to replicate a conventional "pack" of trading cards. In the illustrated embodiment a user may wish to cheer for a particular baseball team.

Cap 81 may be provided with a team name and colors. Each of a plurality of thin, planar patches 82 may bear a likeness of a player for a team. Patch 82 may include a first surface 82*a* bearing a likeness of a player. A second surface (not shown) opposite the first surface may be covered with loop material.

Surface 86 of a display and storage board 85 may be covered with hook material so patches 82 adhere to the board. A user may alter the appearance of the cap 81 by periodically selecting a different patch 82 from the display and storage board.

It is to be understood that the present invention is not limited to the preferred embodiments described above, but encompasses any and all embodiments within the scope of the following claims.

We claim:

1. A hat and patch combination comprising:

a substantially fabric hat having at least a crown, a visor connected to said crown, a first discrete area of hook material located on said crown and proximal to said visor, a second discrete area of hook material located on said crown, said crown including a lower substantially circular edge defining a hat circumference, said first discrete area of hook material separated from and located substantially opposite to said second discrete area of hook material across the hat circumference;

a plurality of patches, each of said patches having a first surface bearing visual indicia and a second surface covered with loop material, each of said patches is connectable to one of said first and second discrete areas of hook material of said hat, and a border of material surrounding said first discrete area of hook material, said material forming said border is different from said hook material and said fabric of said hat.

2. The hat and patch combination according to claim 1, wherein said first discrete area of hook material defines a circular shape.

3. (Amended) The hat and patch combination according to claim 2, wherein said second discrete area of hook material defines a circular area.

4. The hat and patch combination according to claim 3, wherein said at least one patch further comprises a plurality of patches.

5. The hat and patch combination according to claim 1, wherein said border of material is embroidered stitching.

6. The hat and patch combination according to claim 1, wherein said first discrete area of hook material defines a rectangular shape.

7. The hat and patch combination according to claim 6, wherein said second discrete area of hook material defines a circular area.

8. The hat and patch combination according to claim 1, wherein said first discrete area of hook material defines a triangular shape.

9. The hat and patch combination according to claim 8, wherein said second discrete area of hook material defines a circular area.

10. (Amended) The hat and patch combination according to claim 1, wherein said second discrete area of hook material defines a circular area.

11. A cap and patch combination comprising:

a substantially fabric, six-panel cap having at least a crown, a visor connected to said crown, a first discrete area of hook material located on said crown and a second discrete area of hook material located on said crown, said crown including a lower substantially circular edge defining a hat circumference, said first discrete area of hook material separated from and located substantially opposite to said second discrete area of hook material across the hat circumference; a border of material surrounding one of said first and second discrete areas of hook material, said material forming said border is different from said hook material and said fabric of said hat; and a plurality of patches, each of said patches having a first surface bearing visual indicia and a second surface covered with loop material, each of said patches is connectable to one of said first and second discrete areas of hook material of said hat.

12. The cap and patch combination according to claim 11, wherein said first discrete area of hook material is located at a front of said cap and defines two panels of said cap.

13. The cap and patch combination according to claim 12, wherein said second discrete area of hook material defines a circular area located at a rear of said cap.

14. The hat and patch combination according to claim 11, further comprising a border of material surrounding the other of said first and second discrete areas of hook material, said material forming said border is different from said hook material and said fabric of said hat.

15. The cap and patch combination according to claim 11, wherein said first area of hook material is located at a rear of said cap and defines two panels of said cap.

16. A cap and patch combination comprising:

a substantially fabric cap having at least a crown, a visor connected to said crown, a first discrete area of hook or loop material located on said crown and proximal to said visor, a second discrete area of hook or loop material located on said crown, said crown including a lower substantially circular edge defining a hat circumference, said first discrete area of hook or loop material separated from and located substantially opposite to said second discrete area of hook or loop material across the hat circumference, a border of material surrounding said second discrete area of hook or loop material, said material forming said border is different from said hook or loop material and said fabric of said hat; and a plurality of patches, each of said patches connectable to one of said first and second discrete areas of hook or loop material of said hat.

* * * * *